US009611601B1

(12) United States Patent
Anghileri et al.

(10) Patent No.: US 9,611,601 B1
(45) Date of Patent: Apr. 4, 2017

(54) CRASH ABSORBING GUARDRAIL PANEL ASSEMBLY

(71) Applicant: LINDSAY TRANSPORTATION SOLUTIONS, INC., Omaha, NE (US)

(72) Inventors: Marco Anghileri, Milan (IT); Valeria Di Giacomo, Bergamo (IT)

(73) Assignee: Lindsay Transportation Solutions, Inc., Omaha, NE (US)

( * ) Notice: Subject to any disclaimer, the term of this patent is extended or adjusted under 35 U.S.C. 154(b) by 0 days.

(21) Appl. No.: 14/972,422

(22) Filed: Dec. 17, 2015

(51) Int. Cl.
*E01F 15/14* (2006.01)
*E01F 15/04* (2006.01)

(52) U.S. Cl.
CPC ..... *E01F 15/146* (2013.01); *E01F 15/04* (2013.01)

(58) Field of Classification Search
CPC . E01F 15/00; E01F 15/02; E01F 15/04; E01F 15/0407; E01F 15/0423; E01F 15/043; E01F 15/145; E01F 15/146
See application file for complete search history.

(56) References Cited

U.S. PATENT DOCUMENTS 4,330,106 A 5/1982 Chisholm
4,352,484 A * 10/1982 Gertz ..... E01F 15/146 104/254
4,655,434 A 4/1987 Bronstad
4,739,971 A 4/1988 Ruane
4,838,523 A 6/1989 Humble et al.
5,851,005 A 12/1998 Muller et al.
6,036,399 A * 3/2000 Schalk ..... E01F 15/0423 256/13.1
6,554,256 B2 * 4/2003 Ochoa ..... E01F 15/143 256/13.1
6,811,144 B2 11/2004 Denman et al.
7,086,805 B2 8/2006 Smith et al.
7,306,397 B2 * 12/2007 Albritton ..... E01F 15/0423 188/375
7,926,790 B2 4/2011 James
8,360,400 B2 1/2013 Leonhardt et al.
8,424,849 B2 4/2013 James
9,051,698 B1 6/2015 Anghileri et al.
2006/0011900 A1 * 1/2006 Ochoa ..... E01F 15/0423 256/13.1
2008/0224114 A1 * 9/2008 Cheng ..... E01F 15/0423 256/19

FOREIGN PATENT DOCUMENTS

FR 2650010 A1 * 1/1991 ..... E01F 15/025

* cited by examiner

*Primary Examiner* — Jonathan Masinick
(74) *Attorney, Agent, or Firm* — Thomas R. Lampe

(57) ABSTRACT

A crash absorbing guardrail panel assembly including rail panels overlapping at adjacent end portions, an end terminal moving one of the rail panels along the other rail panel when impacted by a vehicle, and braking structure on one of the rail panels engaging an edge of the other rail panel to dissipate kinetic energy during relative sliding movement between the rail panels and absorb impact forces on the end terminal.

9 Claims, 3 Drawing Sheets

10
12
14
16
18
20
22
24
30
32
34
36
38
44
46

CRASH ABSORBING GUARDRAIL PANEL ASSEMBLY

TECHNICAL FIELD

This invention relates to apparatus for absorbing energy when impacted by a vehicle. More specifically, the apparatus relates to a crash absorbing guardrail assembly utilized as a barrier which dissipates the energy of moving vehicles impacting an end terminal of the assembly.

BACKGROUND OF THE INVENTION

It is well known to provide impact absorbing systems, often called "crash attenuators" or "crash cushions" in association with guardrails. The guardrails may be disposed along roadways or utilized adjacent to rigid structures such as pillars, bridge abutments, lighting poles and the like for the purpose of absorbing vehicle impact energy and minimizing the effects of impact on the vehicle, the vehicle occupants and any ancillary structure being protected.

There are many forms and types of energy absorption barriers. The following patents are believed to be representative of a variety of crash attenuator systems including patents disclosing such systems on or in connection with guardrails employing a plurality of overlapping side panels which are relatively movable and telescope in the event of a vehicle collision with an end of the structure: U.S. Pat. No. 4,838,523, issued Jun. 13, 1989, U.S. Pat. No. 4,655,434, issued Apr. 7, 1987, U.S. Pat. No. 4,739,971, issued Apr. 26, 1988, U.S. Pat. No. 7,926,790, issued Apr. 19, 2011, U.S. Pat. No. 8,360,400, issued Jan. 29, 2013, U.S. Pat. No. 8,424,849, issued Apr. 23, 2013, U.S. Pat. No. 4,330,106, issued May 18, 1982, U.S. Pat. No. 7,086,805, issued Aug. 8, 2006, U.S. Pat. No. 5,851,005, issued Dec. 22, 1998, U.S. Pat. No. 6,811,144, issued Nov. 2, 2004 and U.S. Pat. No. 9,051,698, issued Jun. 9, 2015.

As will be seen below, the present invention incorporates sliders of a distinctive character in operative association with overlapping rail panels of a crash absorbing guardrail panel assembly.

The use of sliders per se are known generally in the crash absorbing guardrail art, but the structural combination and manner of operation of the present invention differ considerably from such known impact slider arrangements.

U.S. Pat. No. 7,926,790, issued Apr. 19, 2011, shows an impact slider assembly for a guardrail including a slider connected to a first rail and a slider substantially surrounding the first rail, so that in use, the slider gathers and retains the first and any subsequent rails which telescopically overlap with each other during an impact.

U.S. Pat. No. 8,424,849, issued Apr. 23, 2003, discloses an impact slider assembly for a guardrail which includes: a slider mechanism attached to a first rail and a second rail which substantially conforms with a rail profile; and an integral means for attachment to the first rail, wherein the slider mechanism gathers telescoping rails while substantially maintaining the strength of the rails in a fully redirecting manner.

DISCLOSURE OF INVENTION

The present invention relates to a crash absorbing guardrail panel assembly.

The assembly includes an elongated first rail panel having a first rail panel front portion and a first rail panel rear portion.

An elongated second rail panel is also incorporated in the assembly, the elongated second rail panel having a second rail panel front portion and a second rail rear portion. The first rail panel rear portion and the second rail panel front portion are in side-by-side overlapping relationship.

An end terminal is operatively associated with the first rail panel and responsive to vehicle frontal impact on the end terminal to move the first rail panel rearwardly lengthwise along the second rail panel. The second rail panel includes upper and lower edge portions having edges.

A braking structure is attached to the first rail panel and movable therewith, the braking structure engaging at least one of the upper and lower edge portions of the second rail panel to apply frictional forces thereto resisting rearward lengthwise movement of the front rail panel relative to the second rail panel to dissipate kinetic energy of the first rail panel sliding along the second rail panel and absorb impact forces.

The braking structure attached to the first rail panel is in engagement with the edges of both the upper and lower edge portions of the second rail panel.

Other features, advantages and objects of the present invention will become apparent with reference to the following description and accompanying drawings.

BEST MODE FOR CARRYING OUT THE INVENTION

Figures 1, 2, 3:
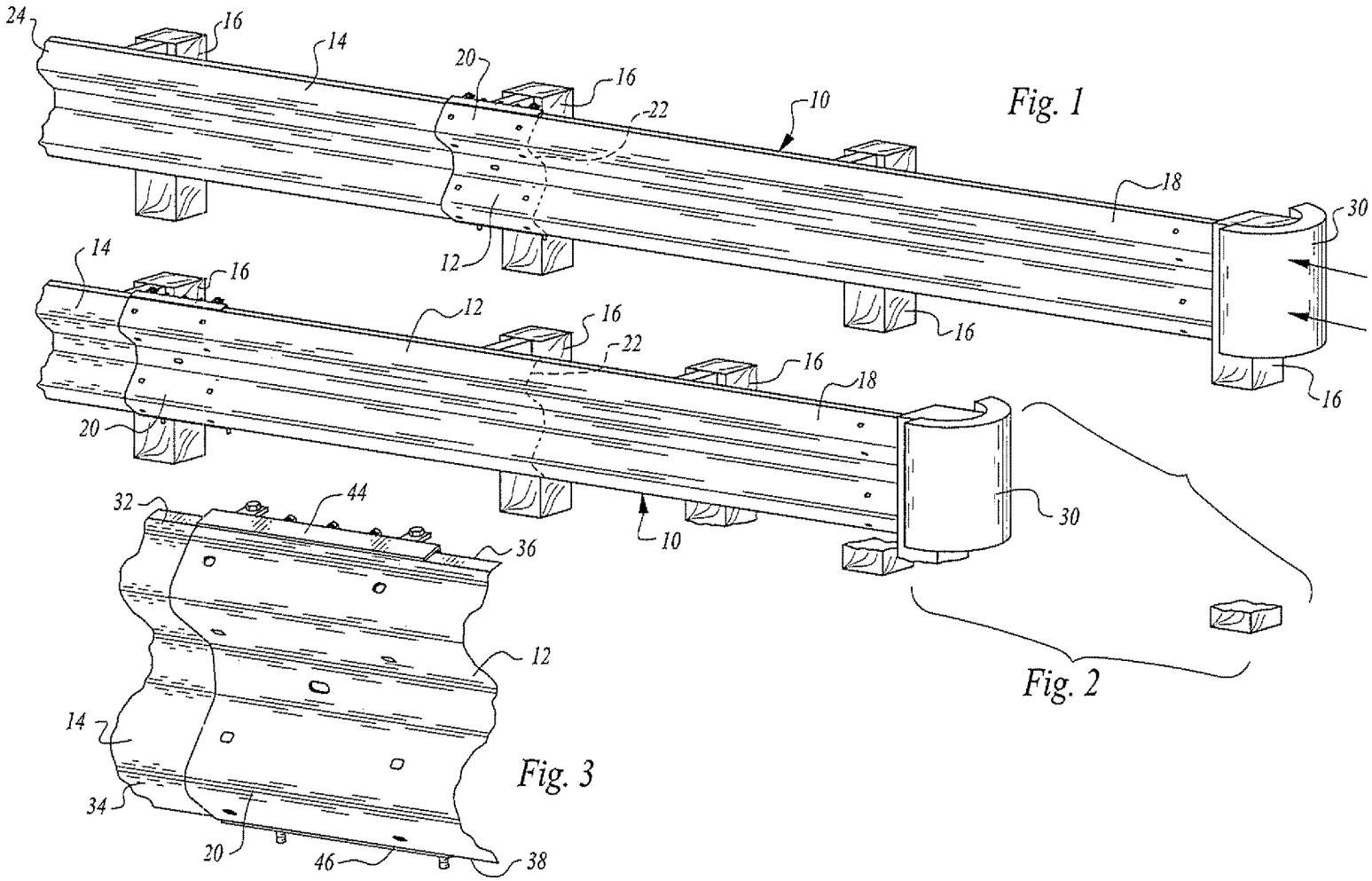
FIG. 1 is a perspective view illustrating a portion of a guardrail panel assembly including inner and outer rail panels and an end terminal positioned in front of the outer rail panel, the structural elements being in the relative positions normally assumed thereby prior to an application of an endwise force on the end terminal as depicted by arrows.
FIG. 2 is a view similar to FIG. 1, but illustrating the condition of the crash absorbing guardrail panel assembly after the end terminal has been impacted by a vehicle.
FIG. 3 is an enlarged, side perspective view illustrating overlapping portions of rail panels of the assembly in the condition shown in FIG. 1 and sliders attached to outer rail panel, the sliders including housings extending over upper and lower edge portions of the inner rail panel.
Figure 4:
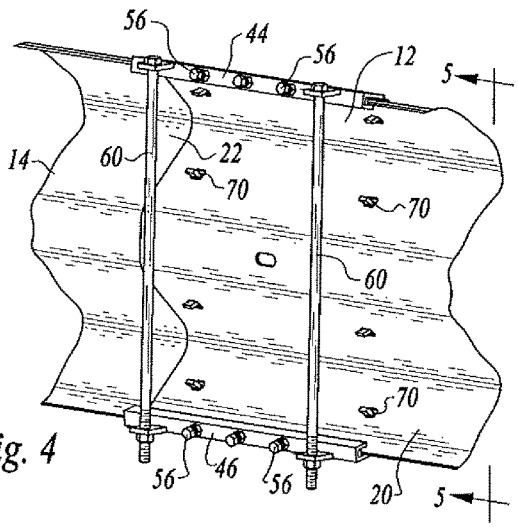
FIG. 4 is a view similar to FIG. 3 illustrating the structural components as observed from the opposite side of the guardrail panel assembly.
Figure 6:
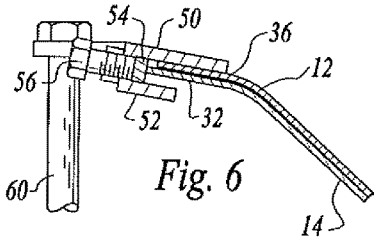
FIG. 6 is a greatly enlarged, cross-sectional view illustrating the structural elements at the top of the guardrail panel assembly portion depicted in FIG. 5.
Figure 5:
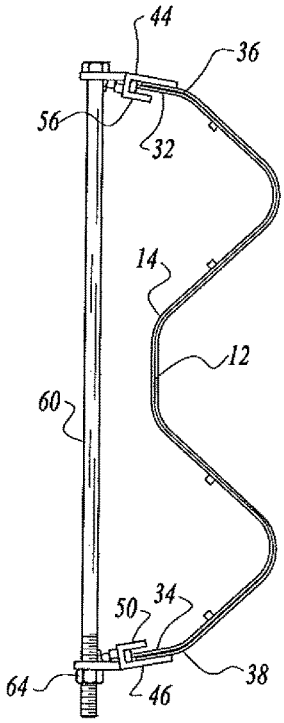
FIG. 5 is an enlarged view taken in the direction of double headed arrow 5-5 in FIG. 4.
Figure 7:
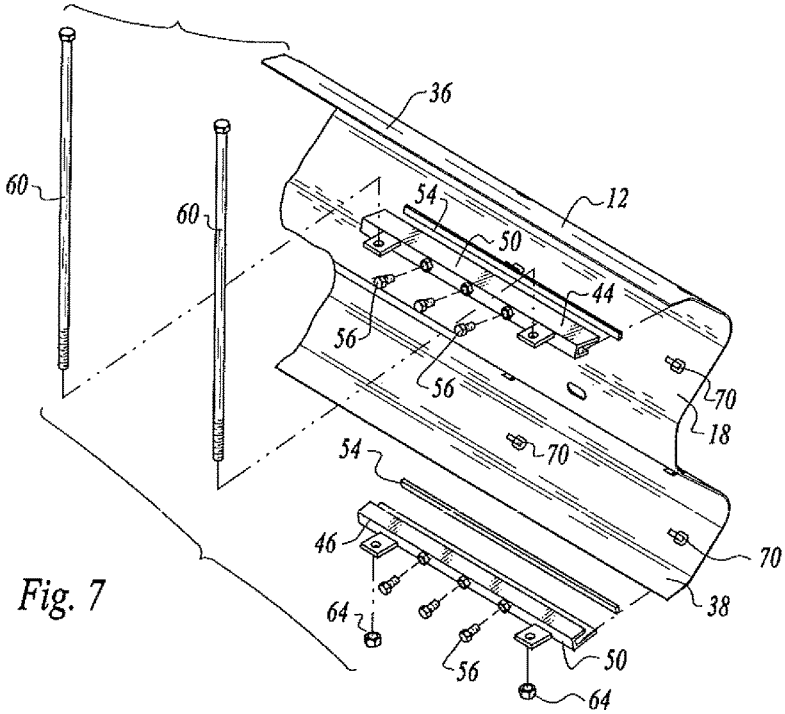
FIG. 7 is an exploded, perspective view of the backside of the rear portion of the outer rail panel and structural components of a braking structure.
Figure 8:
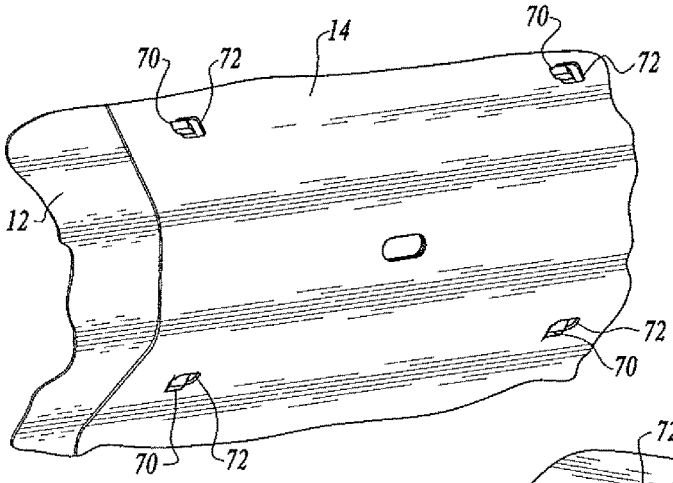
FIG. 8 is a backside, perspective, partial view of overlapping portions of the two rail panels as depicted in FIG. 3 showing teeth on the outer rail panel projecting through apertures of the inner rail panel.

Referring to the drawings, a crash absorbing guardrail panel assembly 10 constructed in accordance with the teachings of the present invention as illustrated.

The assembly includes an elongated outer rail panel 12 and an inner rail panel 14. As is conventional, the rail panels are supported by support posts 16 which are separated from one another and extend along the guardrail.

The outer rail panel 12 has a front portion 18 and a rear portion 20. The inner rail panel 14 has a front portion 22 and a rear portion 24. The outer rail panel rear portion 20 and the inner rail panel front portion 22 are in side-by-side overlapping relationship.

An end terminal 30 is operatively associated with the outer rail panel and responsive to vehicle frontal impact on the end terminal to move the outer rail panel rearwardly lengthwise along the inner rail panel. In the arrangement illustrated, end terminal 30 is located at forwardmost post 16 supporting the outer rail panel front portion 18.

In FIG. 1 arrows show a force being initially applied to the end terminal 30 by an endwise vehicle collision, the vehicle not being illustrated. The crash will sever the post 16 to which outer rail panel 18 is attached and cause the outer rail panel to move rearwardly lengthwise along the inner rail panel. The structure and operation of rail panels, support posts and end terminal are a known combination generally in guardrail constructions.

The crash absorbing guardrail panel assembly of this invention incorporates a braking structure attached to the outer rail panel and movable therewith engaging at least one of the upper and lower edge portions of the inner rail panel to apply frictional forces thereto resisting rearward lengthwise movement of the outer rail panel relative to the inner rail panel to dissipate kinetic energy of the outer rail panel sliding along the inner rail panel and absorb impact forces.

More particularly, in the disclosed embodiment the braking structure attached to the outer rail panel is in engagement with the edges of both the upper and lower edge portions of the inner rail panel.

In the drawings, the upper and lower edge portions of the inner rail panel rear portion are respectively identified by reference numerals 32 and 34. The upper edge portion 32 and the lower edge portion 34 have elongated edges.

The outer rail panel 12 includes an upper edge portion 36 and a lower edge portion 38.

The braking structure of the crash absorbing guardrail panel assembly includes two sliders which are of like configuration. Slider 44 is attached to the upper edge portion 36 and slider 46 is attached to lower edge portion 38. Attachment may be by any suitable means such as welding.

Each of the sliders 44, 46 includes a housing 50 welded or otherwise fixedly attached to the upper and lower edge portions 36, 38 and defining elongated slots 52 receiving the upper and lower edge portions 32, 34 of the inner rail panel.

The sliders 44, 46 also additionally include brake pads 54 positioned in the elongated slots and engageable with the edges of the upper and lower edge portions 32, 34 of inner rail panel 14.

The crash absorbing guardrail panel assembly additionally includes adjustment mechanism for varying the contact pressure of the brake pads on the edges of the upper and lower edge portions of the inner rail panel. The adjustment mechanism comprises bolts threadedly engaged with the housings 50 and projecting into the elongated slots 52. The frictional engagement of the brake pads with the edges dissipates kinetic energy of the outer rail panel sliding along the inner rail panel.

The braking structure of the crash absorbing guardrail panel assembly also includes tie rods 60 extending between the housings 50 and disposed adjacent to and spaced from the outer and inner rail panels. More particularly, the housings include tie rod securement brackets or members 62 defining apertures receiving the tie rods. The tie rods 60 are, in this arrangement, in the form of threaded bolts having nuts 64 applied thereto. The projecting tie rod securement brackets 62 in cooperation with the tie rods keep the rail panels 12, 14 from flaring in the upward or downward directions.

The crash absorbing guardrail panel assembly 10 additionally includes teeth members 70 attached to and projecting from the outer rail panel in the direction of the inner rail panel. The teeth may suitably be welded to the outer rail panel or may be releasably secured thereto with screws or other mechanical means to facilitate repair and replacement.

Inner rail panel 14 defines apertures 72 receiving the teeth. The teeth 72 are configured to engage the inner rail panel and prevent disengagement of the outer and inner rail panels during side impact thereon by a vehicle.

Figure 9:
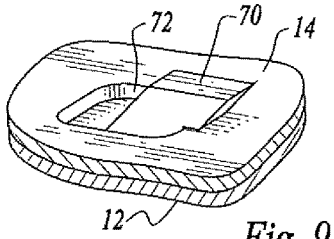
FIG. 9 is a greatly enlarged, perspective view illustrating a tooth attached to the outer rail panel projecting through an aperture of the inner rail panel and in the position assumed thereby when no vehicle impact on the end terminal has occurred.
Figure 10:
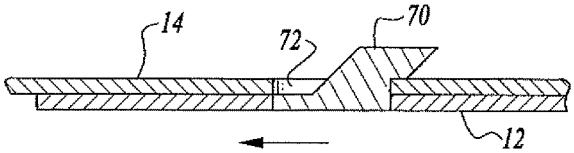
FIGS. 10-13 are enlarged, cross-sectional views illustrating sequential relative positioning of the inner and outer rail panels as force is applied to the outer panel as depicted by arrows when a vehicle impacts the associated end terminal.
Figure 11:
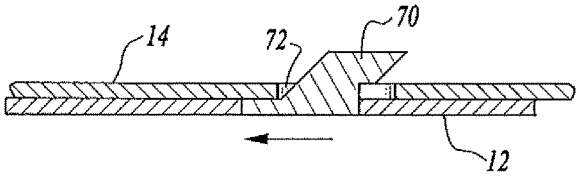
Figure 12:
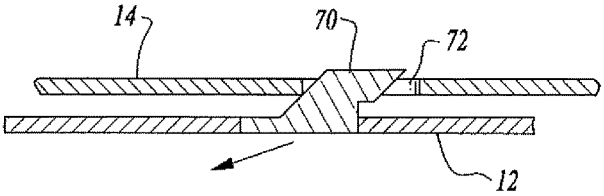
Figure 13:
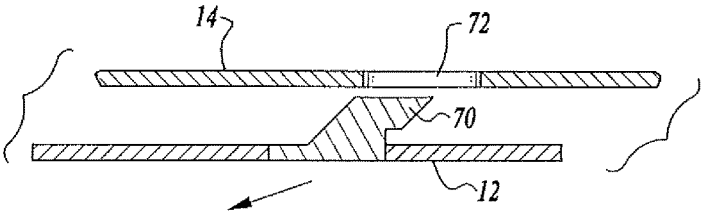

FIGS. 9 through 13 provide a more specific showing of the nature of the teeth and their cooperative relationship with the inner and outer rail panels. FIGS. 9 and 10 show the teeth in the position assumed thereby when the guardrail has not been subjected to a vehicle impact on the end terminal 30. The teeth have a generally hook like configuration and include ramp surfaces 74 engageable by the inner rail panel 14 when the outer rail panel commences rearward movement as shown in FIG. 11. Continued rearward movement of the outer rail panel will cause (as shown in FIG. 12) disengagement between the inner rail panel 14 and outer rail panel 12. This action also contributes to the ability of the crash absorbing guardrail panel assembly to absorb energy caused by an end wise vehicle crash. FIG. 13 shows the tooth 70 completely exited from the aperture 72.

The invention claimed is:

1. A crash absorbing guardrail panel assembly comprising:

an elongated first rail panel having a first rail panel front portion and a first rail panel rear portion;

an elongated second rail panel having a second rail panel front portion and a second rail panel rear portion, said first rail panel rear portion and said second rail panel front portion being in side by side overlapping relationship;

an end terminal operatively associated with said first rail panel and responsive to vehicle frontal impact on the end terminal to move said first rail panel rearwardly lengthwise along said second rail panel, said second rail panel including upper and lower edge portions having edges; and a braking structure attached to said first rail panel and movable therewith engaging at least one of said upper and lower edge portions of said second rail panel to apply frictional forces thereto resisting rearward lengthwise movement of said front rail panel relative to said second rail panel to dissipate kinetic energy of the first rail panel sliding along the second rail panel and absorb impact forces, said braking structure attached to said first rail panel in engagement with the edges of both of said upper and lower edge portions of said second rail panel, and said first rail panel including upper and lower edge portions and said braking structure including two sliders attached to said first rail panel, one of said sliders attached to the upper edge portion of said first rail panel and the other of said sliders attached to the lower edge portion of said first rail panel, said sliders including housings welded or otherwise fixedly attached to the upper and lower edge portions of said first rail panel and defining elongated slots receiving the upper and lower edge portions of said second rail panel, said sliders additionally including brake pads positioned in said elongated slots engageable with the edges of the upper and lower edge portions of said second rail panel.

2. The crash absorbing guardrail panel assembly according to claim 1 additionally comprising an adjustment mechanism for varying the contact pressure of said brake pads on the edges of the upper and lower edge portions of said second rail panel.

3. The crash absorbing guardrail panel assembly according to claim 2 wherein said adjustment mechanism comprises bolts threadedly engaged with the housings and projecting into the elongated slots.

4. The crash absorbing guardrail panel assembly according to claim 3 wherein said braking structure additionally includes tie rods extending between said housings and disposed adjacent to and spaced from said elongated first and second rail panels.

5. The crash absorbing guardrail panel assembly according to claim 4 wherein said housings include tie rod securement members defining apertures receiving said tie rods.

6. The crash absorbing guardrail panel assembly according to claim 4 wherein said tie rods are threaded bolts having nuts applied thereto.

7. The crash absorbing guardrail panel assembly according to claim 1 additionally including teeth members attached to and projecting from said first rail panel in the direction of said second rail panel, said second rail panel defining apertures receiving said teeth, said teeth configured to engage said second rail panel and prevent disengagement of said first and second panels during side impact thereon by a vehicle.

8. The crash absorbing guardrail panel assembly according to claim 7 wherein said teeth members include ramp surfaces engageable by said second rail panel when said first rail panel commences rearward movement to displace the second rail panel away from the first rail panel so that the teeth members are removed from the apertures of said second rail panel.

9. A crash absorbing guardrail panel assembly comprising:

an elongated first rail panel having a first rail panel front portion and a first rail panel rear portion;

an elongated second rail panel having a second rail panel front portion and a second rail panel rear portion, said first rail panel rear portion and said second rail panel front portion being in side by side overlapping relationship;

an end terminal operatively associated with said first rail panel and responsive to vehicle frontal impact on the end terminal to move said first rail panel rearwardly lengthwise along said second rail panel, said second rail panel including upper and lower edge portions having edges;

a braking structure attached to said first rail panel and movable therewith engaging at least one of said upper and lower edge portions of said second rail panel to apply frictional forces thereto resisting rearward lengthwise movement of said front rail panel relative to said second rail panel to dissipate kinetic energy of the first rail panel sliding along the second rail panel and absorb impact forces; and teeth members attached to and projecting from said first rail panel in the direction of said second rail panel, said second rail panel defining apertures receiving said teeth, said teeth having a generally hook like configuration and engaging said second rail panel and preventing disengagement of said first and second rail panels during side impact thereon by a vehicle, said teeth members including ramp surfaces engaging said second rail panel when said first rail panel commences rearward movement resulting from an endwise vehicle crash and displacing the second rail panel away from the first rail panel so that the teeth members are removed from the apertures of said second rail panel, the first and second rail panels disengaged and contributing to the ability of the crash absorbing guardrail panel assembly to absorb energy caused by an endwise vehicle crash.

* * * * *